US009932829B2

(12) United States Patent
Tsuboi

(10) Patent No.: US 9,932,829 B2
(45) Date of Patent: Apr. 3, 2018

(54) EXPANDER

(71) Applicant: Kobe Steel, Ltd., Kobe-shi (JP)

(72) Inventor: Noboru Tsuboi, Kako-gun (JP)

(73) Assignee: Kobe Steel, Ltd., Kobe-shi (JP)

( * ) Notice: Subject to any disclaimer, the term of this patent is extended or adjusted under 35 U.S.C. 154(b) by 499 days.

(21) Appl. No.: 14/230,149

(22) Filed: Mar. 31, 2014

(65) Prior Publication Data

US 2014/0356208 A1 Dec. 4, 2014

(30) Foreign Application Priority Data

May 31, 2013 (JP) ..... 2013-115036

(51) Int. Cl.

| | |
|---|---|
| ***F01C 21/02*** | (2006.01) |
| ***F01C 1/16*** | (2006.01) |
| ***F01C 21/04*** | (2006.01) |
| ***F01C 1/02*** | (2006.01) |
| *F01C 19/12* | (2006.01) |

(52) U.S. Cl.

CPC ..... *F01C 21/02* (2013.01); *F01C 1/02* (2013.01); *F01C 1/16* (2013.01); *F01C 21/04* (2013.01); *F01C 19/125* (2013.01); *F04C 2240/52* (2013.01)

(58) Field of Classification Search

CPC .... F01C 1/02; F01C 1/16; F01C 21/04; F01C 21/02; F01C 19/125; F04C 2240/52

USPC ..... 418/83, 104, 201, 202, 203; 290/52; 277/3, 71

See application file for complete search history.

(56) References Cited

U.S. PATENT DOCUMENTS 3,178,104 A 4/1965 Williams et al.
4,311,021 A * 1/1982 Leo ..... F04C 27/009 418/86

(Continued)

FOREIGN PATENT DOCUMENTS

CN 201420941 Y 3/2010
CN 103867233 A 6/2014

(Continued)

OTHER PUBLICATIONS

JP 2013-083169, Machine Translation, Translated on Jul. 21, 2017.*

(Continued)

*Primary Examiner* — Patrick Maines
(74) *Attorney, Agent, or Firm* — Oblon, McClelland, Maier & Neustadt, L.L.P.

(57) ABSTRACT

In order to suppress the damage and the degradation in durability of a bearing of an expander, simplify the configuration of the expander, and reduce the manufacturing cost thereof, an expander of the present invention includes an expander rotor that is rotationally driven by an expanding force transmitted from vapor of a working medium introduced into an expansion chamber and a first bearing that supports a first rotation shaft of the expander rotor to a vapor inlet, a casing includes therein first bearing chambers that have a pressure lower than that of the vapor inlet and accommodate the first bearing, and a passage that leads lubricant to a low-pressure portion having a pressure lower than that of the first bearing chamber is connected to a position above the lowermost portion of the first bearing in the first bearing chamber.

7 Claims, 4 Drawing Sheets

(56) References Cited

U.S. PATENT DOCUMENTS

| | | | | |
|---|---|---|---|---|
| 4,758,136 | A * | 7/1988 | Pamlin | F04C 29/02 418/100 |
| 4,781,553 | A * | 11/1988 | Nomura | F04C 27/009 277/412 |
| 6,612,820 | B1 | 9/2003 | Staat et al. | |
| 2007/0175212 | A1 | 8/2007 | Uno et al. | |
| 2012/0237382 | A1 * | 9/2012 | Yoshimura | F01K 25/06 418/85 |
| 2013/0052072 | A1 | 2/2013 | Smith et al. | |
| 2014/0159369 | A1 * | 6/2014 | Tsuboi | F01K 25/06 290/52 |

FOREIGN PATENT DOCUMENTS

| | | | | |
|---|---|---|---|---|
| GB | 2477777 | A | 8/2011 | |
| JP | 62-502279 | A | 9/1987 | |
| JP | 4684882 | | 5/2011 | |
| JP | 2013-83169 | A | 5/2013 | |
| JP | 2013083169 | A * | 5/2013 | |
| WO | WO 00/42322 | A1 | 7/2000 | |
| WO | WO 2006/131759 | A2 | 12/2006 | |
| WO | WO 2006/131759 | A3 | 12/2006 | |
| WO | WO 2008121070 | A1 * | 10/2008 | F01K 25/10 |

OTHER PUBLICATIONS

Extended European Search Report dated Jun. 11, 2014, in Patent Application No. 14161916.3.

* cited by examiner

EXPANDER

BACKGROUND OF THE INVENTION

Field of the Invention

The present invention relates to an expander.

Description of the Related Art

A power generation apparatus disclosed in Japanese Patent No. 4684882 includes an expander, a generator, and a cooling medium pump which are disposed in order from the downside toward the upside and are integrated with one another.

The expander includes a rotary scroll that is rotated by the expansion of a vapor cooling medium flowing into a working chamber. The generator includes a motor shaft that is connected to the rotary scroll through a shaft and a rotor that is attached to the motor shaft. In the generator, power is generated by the rotation of the motor shaft and the rotor using the rotational movement of the rotary scroll transmitted through the shaft. A bearing that supports the motor shaft is provided inside a housing of the generator.

A vapor cooling medium including lubricant is introduced into the working chamber. The vapor cooling medium that has been used to rotate the rotary scroll flows to the upper portion of the generator through a discharge gas passage formed in the housing of the generator, and flows into the housing. At this time, the flow velocity of the vapor cooling medium decreases with an increase in the size of the passage, and hence the lubricant is separated from the cooling medium. The separated lubricant falls to the space inside the housing, further flows and falls while being supplied to the bearing or the like, and then is accumulated in an oil reservoir between the housing and the rotary scroll. The lubricant that is accumulated in the oil reservoir is pumped toward the cooling medium pump through a shaft passage formed inside the shaft, is used to lubricate each component, and is discharged to the outside along with a liquid cooling medium while being dissolved in the liquid cooling medium.

SUMMARY OF THE INVENTION

In the expander of the related art, since the lubricant flows and falls from the bearing to the oil reservoir, there is a case in which oil shortage may occur in the bearing during the activation of the expander. Accordingly, there is a concern that the bearing may be damaged or the durability of the bearing may be degraded. Further, since the oil reservoir is formed between the housing and the rotary scroll and the cooling medium pump is provided to discharge the cooling medium and the lubricant having been used for the lubrication, the configuration of the expander becomes complicated, and the manufacturing cost increases.

The present invention is made to solve the above-described problems, and an object thereof is to suppress the damage and the degradation in durability of the bearing of the expander, simplify the configuration of the expander, and reduce the manufacturing cost thereof.

In order to attain the above-described object, an expander according to the present invention includes: a casing that includes therein an expansion chamber into which lubricant and vapor of a working medium are introduced; an expander rotor that is rotationally driven by an expanding force transmitted from the vapor of the working medium introduced into the expansion chamber; a first bearing that supports a rotation shaft of the expander rotor to a working medium feeding port of the expansion chamber so that the expander rotor is rotatable; a second bearing that supports the rotation shaft of the expander rotor to a working medium lead-out port of the expansion chamber so that the expander rotor is rotatable; a first bearing chamber that is provided inside the casing and accommodates the first bearing, the pressure inside the first bearing chamber being lower than that of the feeding port of the expansion chamber; and a lubricant passage that connects a position above a lowermost portion of the first bearing in the first bearing chamber to a low-pressure portion having a pressure lower than that of the first bearing chamber.

In the expander, since the pressure of the first bearing chamber is lower than that of the feeding port of the expansion chamber, a part of the lubricant and the working medium introduced into the expansion chamber through the feeding port flow into the first bearing chamber. Then, since the passage that leads the lubricant from the first bearing chamber to the low-pressure portion is connected to the first bearing chamber at a position above the lowermost portion of the first bearing, the lubricant remains in the lowermost portion of the first bearing even when the lubricant is discharged through the passage inside the first bearing chamber. For this reason, the oil shortage of the first bearing may be prevented during the activation of the expander, and hence the damage and the degradation in durability of the first bearing may be suppressed. Further, in the expander, since the lubricant having been used to lubricate the first bearing is discharged to the low-pressure portion having a pressure lower than that of the first bearing chamber through the passage in the first bearing chamber due to the pressure difference, there is no need to provide an oil reservoir for accumulating the lubricant inside the casing and a pump for discharging the lubricant. For this reason, the configuration of the expander may be simplified, and the manufacturing cost thereof may be reduced.

In the expander, a shaft seal that seals the outer periphery of the rotation shaft may be provided at a position between the first bearing chamber and the expansion chamber inside the casing, and a lower end of an end of the lubricant passage may be located below a lowermost portion of the shaft seal.

According to this configuration, it is possible to prevent the lubricant from being accumulated to a position equal to or higher than the lowermost portion of the shaft seal even when the lubricant is accumulated in the first bearing chamber. For this reason, it is possible to suppress the loss of the power caused by the agitation of the lubricant during the rotation of the rotor with an excessive increase in the amount of the lubricant accumulated in the first bearing chamber.

In this case, an end of the lubricant passage may be connected to a side portion of the first bearing chamber.

In the expander, the expansion chamber may include an intermediate portion that is located between the working medium feeding port with respect to the expansion chamber and the working medium lead-out port from the expansion chamber and has an intermediate pressure between the feeding port and the lead-out port, and the low-pressure portion may be the intermediate portion.

According to this configuration, the lubricant having been used to lubricate the first bearing may be returned from the first bearing chamber to the intermediate portion of the expansion chamber through the lubricant passage. Accordingly, the lubricant returned to the intermediate portion may be used to lubricate the expander rotor.

In the expander, a second bearing chamber that has a pressure lower than that of the first bearing chamber and accommodates the second bearing may be provided inside the casing, and the low-pressure portion may be the second bearing chamber.

According to this configuration, the lubricant having been used to lubricate the first bearing may be used to lubricate the second bearing while being supplied from the first bearing chamber to the second bearing chamber through the lubricant passage.

In the expander, the casing may be provided with a discharge port that has a pressure lower than that of the first bearing chamber and discharges the working medium discharged from the lead-out port of the expansion chamber to the outside of the casing, and the low-pressure portion may be the discharge port.

According to this configuration, the lubricant having been used to lubricate the first bearing may be discharged from the first bearing chamber the outside of the casing through the lubricant passage along with the working medium from the expansion chamber.

The expander may further include a pair of expander rotors including the expander rotor, a pair of the first bearings that supports the rotation shafts of the pair of expander rotors, wherein the casing may include therein a pair of the first bearing chambers respectively accommodating the pair of first bearings and a communication passage causing the pair of first bearing chambers to communicate with each other, and the communication passage may be located above the lowermost portion of each first bearing.

According to this configuration, it is possible to prevent the oil shortage in the pair of first bearings during the activation of the expander including the pair of expander rotors, and hence to suppress the damage and the degradation in durability of the pair of first bearings.

As described above, according to the present invention, it is possible to suppress the damage and the degradation in durability of the bearing of the expander, simplify the configuration of the expander, and reduce the manufacturing cost thereof.

DESCRIPTION OF THE PREFERRED EMBODIMENTS

Hereinafter, an embodiment of the present invention will be described with reference to the drawings.

Figure 1:
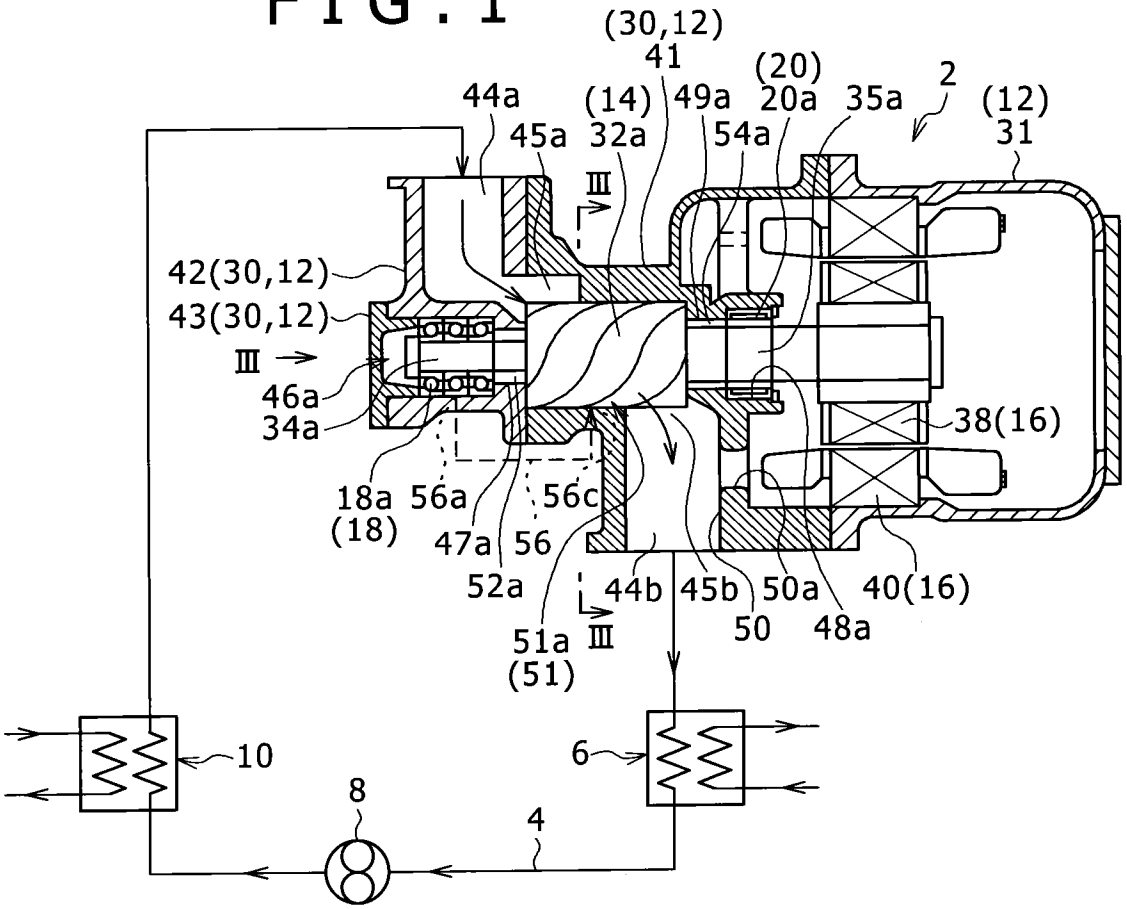
FIG. 1 is a schematic view illustrating a power generation system that uses an expander according to an embodiment of the present invention.

FIG. 1 illustrates a power generation system that uses an expander of this embodiment. The power generation system is a power generation system that uses a Rankine cycle and adopts a binary generation system in which power is recycled from low-temperature exhaust heat by the use of a working medium with a low boiling point. As the working medium, for example, a cooling medium such as R245fa (1, 1, 1, 3, 3-Pentafluoropropane) is used. As shown in FIG. 1, the power generation system includes a power generation apparatus 2, a circulation flow passage 4, a condenser 6, a circulation pump 8, and an evaporator 10.

Although the detailed structure of the power generation apparatus 2 will be described below, the power generation apparatus 2 includes a screw-type expander 14 and a generator 16. In the power generation apparatus 2, expander rotors 32*a* and 32*b* to be described later in the expander 14 are rotationally driven by an expanding force of vapor of a working medium, and power is generated by the rotation of a generator rotor 38 to be described later in the generator 16 with the rotation of the expander rotors 32*a* and 32*b*.

The circulation flow passage 4 causes a discharge port 44*b* and an inlet 44*a* of the power generation apparatus 2 to communicate with each other. Lubricant and vapor of the working medium having been used for the power generation are discharged from the discharge port 44*b* of the power generation apparatus 2. The circulation flow passage 4 leads a mixed fluid of the lubricant and the vapor of the working medium discharged from the discharge port 44*b* to the inlet 44*a*.

The condenser 6 is provided in the circulation flow passage 4. The condenser 6 cools the mixed fluid that is discharged from the discharge port 44*b* to the circulation flow passage 4 and flows into the condenser 6 while exchanging the heat of the mixture fluid with low-temperature cooling water so as to condense the vapor of the working medium in the mixed fluid. Accordingly, the mixed fluid that is discharged from the condenser 6 is obtained by mixing the liquid-phase working medium with the lubricant.

The circulation pump 8 is provided at the downstream position of the condenser 6 in the circulation flow passage 4. The circulation pump 8 pressure-feeds the mixed fluid discharged from the condenser 6 toward the downstream side.

The evaporator 10 is provided at the downstream position of the circulation pump 8 in the circulation flow passage 4. The evaporator 10 exchanges heat between a heating medium supplied to the evaporator 10 and the mixed fluid pressure-fed from the circulation pump 8 so as to evaporate the working medium in the mixed fluid. Furthermore, as the heating medium, an exhaust gas of a vehicle, hot water, or steam is used. Accordingly, the mixed fluid that is discharged from the evaporator 10 and is supplied to the inlet 44*a* of the power generation apparatus 2 is obtained by mixing the vapor of the working medium with the liquid-phase lubricant.

In the power generation system, a circulation circuit is formed such that the working medium is supplied from the evaporator 10 to the power generation apparatus 2 through the circulation flow passage 4, the working medium that is discharged from the power generation apparatus 2 to the circulation flow passage 4 is supplied to the condenser 6, the working medium that is supplied to the condenser 6 returns to the evaporator 10 through the circulation pump 8. Since the working medium is circulated in the circulation circuit of the power generation system, electric energy is generated from the exhaust heat.

Next, a configuration of the power generation apparatus 2 of this embodiment will be described in detail.

As shown in FIG. 1, the power generation apparatus 2 includes a casing 12, the expander 14, the generator 16, a plurality of first bearings 18, and a plurality of second bearings 20.

The casing 12 forms the outer surface of the power generation apparatus 2, and is provided so as to extend in the horizontal direction. The casing 12 includes an expander casing 30 that accommodates the expander 14 therein and a generator casing 31 that accommodates the generator 16 therein. The expander casing 30 and the generator casing 31 are fastened to each other so as to form the casing 12.

The expander casing 30 includes an expander casing body 41, an expander casing inlet-side portion 42, and a cover portion 43. The generator casing 31, the expander casing body 41, and the expander casing inlet-side portion 42 are arranged in series in the horizontal direction. The expander casing body 41 is fastened to the generator casing 31, and the expander casing inlet-side portion 42 is fastened to the expander casing body 41. The cover portion 43 is attached to the end opposite to the expander casing body 41 in the expander casing inlet-side portion 42. The cover portion 43 seals an opening formed in the end of the expander casing inlet-side portion 42.

As shown in FIG. 1, the upper portion of the expander casing inlet-side portion 42 is provided with the inlet 44*a* into which the mixed fluid of the vapor of the working medium and the lubricant flows. The lower portion of the expander casing body 41 is provided with the discharge port 44*b* that is opened downward. The discharge port 44*b* discharges the vapor of the working medium and the lubricant having been used to rotationally drive expander rotors 32*a* and 32*b* of the expander 14 to the outside of the expander casing 30.

Further, a vapor inlet 45*a* communicating with the inlet 44*a* and a vapor outlet 45*b* communicating with the discharge port 44*b* are provided inside the expander casing body 41. The vapor inlet 45*a* is a feeding port through which the vapor of the working medium flows into an expansion chamber 51 to be described later, and the vapor outlet 45*b* is a lead-out port through which the vapor of the working medium flows from the expansion chamber 51. The vapor inlet 45*a* is provided in the end distant from the generator 16 in the expander rotors 32*a* and 32*b*, and the vapor outlet 45*b* is provided in the end close to the generator 16 in the expander rotors 32*a* and 32*b*. The expander casing body 41 includes a partition wall 50 that is formed between the discharge port 44*b* and the space on the generator 16 side. The partition wall 50 is provided with a communication port 50*a* that causes the space inside the discharge port 44*b* to communicate with the space on the generator 16 side.

Figure 2:
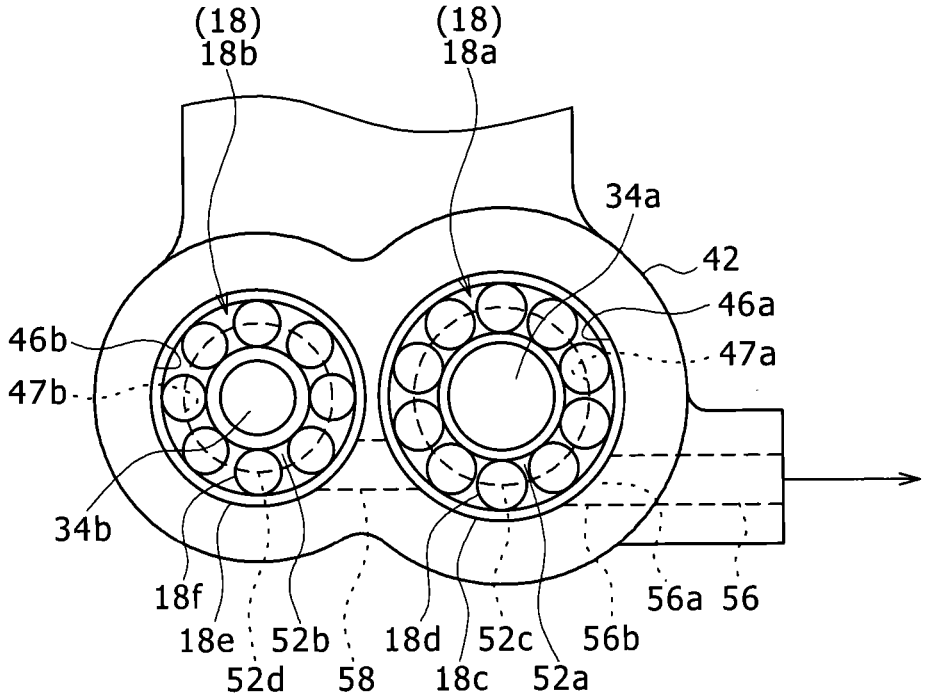
FIG. 2 is a view illustrating a state where a cover portion is separated from an expander casing when viewed from the direction of the arrow II of FIG. 1.
Figure 3:
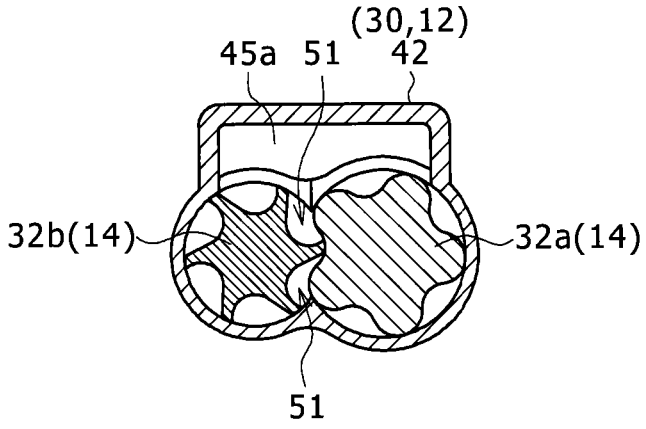
FIG. 3 is a cross-sectional view of the expander taken along the line III-III of FIG. 1.

FIG. 2 is a view illustrating a state where the cover portion 43 is separated from the expander casing 30 of the power generation apparatus 2 when viewed from the direction of the arrow II of FIG. 1, and FIG. 3 is a cross-sectional view illustrating the power generation apparatus 2 taken along the line of FIG. 1.

As shown in FIG. 3, the expander 14 includes a pair of expander rotors 32*a* and 32*b* that rotates about both axes so as to engage with each other. The expander rotors 32*a* and 32*b* are screw rotors. As shown in FIG. 1, one expander rotor 32*a* is provided with a first rotation shaft 34*a* that extends from one end of the expander rotor 32*a* in the axial direction and a second rotation shaft 35*a* that extends from the other end of the expander rotor 32*a* in the axial direction. The other expander rotor 32*b* is provided with a first rotation shaft 34*b* (see FIG. 2) and a second rotation shaft (not shown) as in the expander rotor 32*a*. The pair of expander rotors 32*a* and 32*b* is disposed so that the axial directions thereof match the horizontal direction as the extension direction of the casing 12 inside the expander casing 30 and is disposed in parallel.

A spiral tooth is formed in each outer peripheral portion of the expander rotors 32*a* and 32*b*. As shown in FIG. 3, the teeth of the pair of expander rotors 32*a* and 32*b* engage with each other so that an expansion chamber 51 is formed between the teeth of the pair of expander rotors 32*a* and 32*b*. The mixed fluid that flows into the expander casing 30 through the inlet 44*a* passes through the vapor inlet 45*a* so as to be introduced into the expansion chamber 51. Each of the pair of expander rotors 32*a* and 32*b* rotates about its axis so that the expansion chamber 51 is expanded by the expanding force of the vapor of the working medium in the mixed fluid introduced into the expansion chamber 51. With the rotation of the expander rotors 32*a* and 32*b*, the expansion chamber 51 moves toward the generator 16 and communicates with the vapor outlet 45*b*. Accordingly, the vapor of the working medium inside the expansion chamber 51 is discharged to the discharge port 44*b* through the vapor outlet 45*b*.

As shown in FIG. 1, the generator 16 includes the generator rotor 38 that is connected to the expander rotor 32*a* that is one of the expander rotors 32*a* and 32*b*, and a stator 40 that is disposed at the outside of the generator rotor 38 in the radial direction so as to surround the generator rotor 38. The generator rotor 38 is disposed so as to be coaxial with the expander rotor 32*a*, and is connected to the expander rotor 32*a* through the second rotation shaft 35*a*. The generator rotor 38 rotates along with the expander rotor 32*a*. With the rotation of the generator rotor 38, power is generated between the generator rotor 38 and the stator 40.

The plurality of first bearings 18 are disposed inside the expander casing inlet-side portion 42. As shown in FIG. 2, the plurality of first bearings 18 include a first bearing 18*a* that supports the first rotation shaft 34*a* of one expander rotor 32*a* and a first bearing 18*b* that supports the first rotation shaft 34*b* of the other expander rotor 32*b*.

One first bearing 18*a* supports the first rotation shaft 34*a* at the vapor inlet 45*a* side so that the expander rotor 32*a* is rotatable, and the first bearing 18*b* supports the first rotation shaft 34*b* at the vapor inlet 45*a* side so that the expander rotor 32*b* is rotatable. Each of the first bearings 18*a* and 18*b* is a ball bearing. As shown in FIG. 2, the first bearing 18*a* includes a plurality of balls 18*d* as rolling elements, and the first bearing 18*b* includes a plurality of balls 18*f* as rolling elements.

As shown in FIG. 1, the plurality of second bearings 20 are provided inside the expander casing body 41. The plurality of second bearings 20 include a second bearing 20*a* that supports the second rotation shaft 35*a* of one expander rotor 32*a* and a second bearing (not shown) that supports the second rotation shaft (not shown) of the other expander rotor 32*b*.

As shown in FIG. 1, the second bearing 20*a* supports the second rotation shaft 35*a* at the vapor outlet 45*b* side so that the expander rotor 32*a* is rotatable, and the second bearing (not shown) supports the second rotation shaft (not shown) at the vapor outlet 45*b* side so that the expander rotor 32*b* (see FIG. 3) is rotatable.

As shown in FIGS. 1 and 2, a pair of first bearing chambers 46*a* and 46*b* respectively accommodating the first bearing 18*a* and the first bearing 18*b* is provided below the inlet 44*a* inside the expander casing inlet-side portion 42. The pair of first bearing chambers 46*a* and 46*b* is disposed in parallel. The pressure inside each of the first bearing chambers 46*a* and 46*b* is lower than the pressure of the expansion chamber 51 located on the vapor inlet 45*a* side and the vapor inlet 45*a*. Further, inside the expander casing inlet-side portion 42, a pair of first shaft sealing chambers 47*a* and 47*b* is formed between the pair of first bearing chambers 46*a* and 46*b* and the expansion chamber 51. The first shaft sealing chambers 47*a* and 47*b* accommodate first shaft seals 52*a* and 52*b* that seal the outer peripheries of the corresponding first rotation shafts 34*a* and 34*b*.

As shown in FIG. 1, the second bearing chamber 48*a* accommodating the second bearing 20*a* and the other second bearing chamber (not shown) accommodating the other second bearing (not shown) are provided in parallel inside the expander casing body 41. Further, the second shaft sealing chamber 49*a* is provided between the second bearing chamber 48*a* and the expansion chamber 51, and the second shaft sealing chamber (not shown) is provided between the second bearing chamber and the expansion chamber 51. The second shaft sealing chamber 49*a* accommodates a second shaft seal 54*a* that seals the outer periphery of one second rotation shaft 35*a*, and the second shaft sealing chamber accommodates a second shaft seal (not shown) that seals the second rotation shaft.

As shown in FIG. 2, the first bearing chamber 46*a* is connected with a passage 56 that leads the lubricant to a low-pressure portion having a pressure lower than that of the first bearing chamber 46*a*. An end 56*a* of the passage 56 is connected to the side portion of the first bearing chamber 46*a* at a position above a lowermost portion 18*c* of the first bearing 18*a*. Specifically, the end 56*a* of the passage 56 is connected to the side portion of the first bearing chamber 46*a* at a position above the lower end of the ball 18*d* of the lowermost portion 18*c* of the first bearing 18*a*. A lower end 56*b* of the end 56*a* of the passage 56 is located above the lowermost portion 18*c* of the first bearing 18*a*, and a lowermost portion 52*c* of the first shaft seal 52*a* is located below the lowermost portion of the first shaft sealing chamber 47*a*.

As shown in FIG. 1, an end 56*c* of the passage 56 is connected to an intermediate portion 51*a* of the expansion chamber 51 as the low-pressure portion. The intermediate portion 51*a* of the expansion chamber 51 is located between the vapor inlet 45*a* and the vapor outlet 45*b*. The pressure of the intermediate portion 51*a* of the expansion chamber 51 is the intermediate pressure between the vapor inlet 45*a* and the vapor outlet 45*b*, and is lower than those of the first bearing chambers 46*a* and 46*b*.

As shown in FIG. 2, a communication passage 58 that causes the pair of first bearing chambers 46*a* and 46*b* to communicate with each other is provided between the pair of first bearing chambers 46*a* and 46*b* inside the expander casing inlet-side portion 42. The communication passage 58 is a hole that connects the pair of first bearing chambers 46*a* and 46*b* to each other, and leads the lubricant inside the first bearing chamber 46*b* toward the first bearing chamber 46*a* connected with the passage 56.

The communication passage 58 is located above the lowermost portions 18*c* and 18*e* of the first bearings 18*a* and 18*b*. Specifically, one end of the communication passage 58 is connected to the first bearing chamber 46*a* at a position above the lower end of the ball 18*d* of the lowermost portion 18*c* of the first bearing 18*a*, and the other end of the communication passage 58 is connected to the first bearing chamber 46*b* at a position above the lower end of the ball 18*f* of the lowermost portion 18*e* of the first bearing 18*b*. Further, the lower end of the communication passage 58 is located below the lowermost portions 52*c* and 52*d* of the first shaft seals 52*a* and 52*b*, that is, the lowermost portions of the first shaft sealing chambers 47*a* and 47*b*.

In this embodiment, a part of the working medium and the lubricant in the mixed fluid introduced from the vapor inlet 45*a* (see FIG. 1) into the expansion chamber 51 (see FIG. 3) flow into the first bearing chambers 46*a* and 46*b* through the first shaft sealing chambers 47*a* and 47*b* by the pressure difference between the expansion chamber 51 and the first bearing chambers 46*a* and 46*b* (see FIG. 2). The lubricant that has been used to lubricate the first bearing 18*a* while flowing into the first bearing chamber 46*a* flows to the intermediate portion 51*a* of the expansion chamber 51 through the passage 56 due to the pressure difference between the first bearing chamber 46*a* and the intermediate portion 51*a* of the expansion chamber 51. The lubricant that has been used to lubricate the first bearing 18*b* in the first bearing chamber 46*b* flows to the first bearing chamber 46*a* through the communication passage 58 and flows to the intermediate portion 51*a* of the expansion chamber 51 through the passage 56 due to the pressure difference between the first bearing chambers 46*a*, 46*b* and the intermediate portion 51*a* of the expansion chamber 51.

Since the end 56*a* of the passage 56 is connected to the first bearing chamber 46*a* at a position above the lowermost portion 18*c* of the first bearing 18*a*, the lubricant remains in the lowermost portion 18*c* of the first bearing 18*a* even when the lubricant flows from the first bearing chamber 46*a* to the intermediate portion 51*a* of the expansion chamber 51 through the passage 56. Specifically, the lower end of the ball 18*d* located at the lowermost portion 18*c* of the first bearing 18*a* is continuously immersed into the lubricant. Further, since the communication passage 58 causing the pair of first bearing chambers 46*a* and 46*b* to communicate with each other is located above the lowermost portions 18*c* and 18*e* of the first bearings 18*a* and 18*b*, the lubricant remains in the lowermost portion 18*e* of the first bearing 18*b* even when the lubricant flows from the first bearing chamber 46*b* into one first bearing chamber 46*a* through the communication passage 58. Specifically, the lower end of the ball 18*f* located at the lowermost portion 18*e* of the first bearing 18*b* is continuously immersed in the lubricant. With the above-described configuration, the oil shortage of the first bearings 18*a* and 18*b* may be prevented during the activation of the power generation apparatus 2, and hence the damage and the degradation in durability of the first bearings 18*a* and 18*b* may be suppressed.

Further, in this embodiment, since the lubricant having been used to lubricate the first bearings 18*a* and 18*b* is discharged from the first bearing chambers 46*a* and 46*b* into the intermediate portion 51*a* of the expansion chamber 51 of which the pressure is lower than those of the first bearing chambers 46*a* and 46*b* due to the pressure difference, there is no need to provide an oil reservoir for accumulating the lubricant inside the casing 12 and a pump for discharging the lubricant. For this reason, the configuration of the power generation apparatus 2 may be simplified and the manufacturing cost thereof may be reduced.

Further, in this embodiment, since the lower end 56*b* of the end 56*a* of the passage 56 connected to the first bearing chamber 46*a* is located below the lowermost portion 52*c* of the first shaft seal 52*a*, it is possible to prevent the lubricant from being accumulated to a position equal to or higher than the lowermost portion 52*c* of the first shaft seal 52*a* even when the lubricant is accumulated in the first bearing chamber 46*a*. Further, since the lower end of the end of the communication passage 58 connected to the first bearing chamber 46*b* is located below the lowermost portion 52*d* of the first shaft seal 52*b*, it is possible to prevent the lubricant from being accumulated to a position equal to or higher than the lowermost portion 52*d* of the first shaft seal 52*b* even when the lubricant is accumulated in the first bearing chamber 46*b*. For this reason, it is possible to suppress the loss of the power caused by the agitation of the lubricant during the rotation of the expander rotors 32*a* and 32*b* with an excessive increase in the amount of the lubricant accumulated in the first bearing chambers 46*a* and 46*b*.

Further, in this embodiment, since the low-pressure portion connected to the passage 56 is the intermediate portion 51*a* of the expansion chamber 51, the lubricant having been used to lubricate the first bearings 18*a* and 18*b* may be returned to the intermediate portion 51*a* of the expansion chamber 51 through the passage 56. Accordingly, the lubricant that is returned to the intermediate portion 51*a* may be used to lubricate the expander rotors 32*a* and 32*b*.

Furthermore, it should be understood that the embodiment disclosed herein is merely an example in every respect. The scope of the present invention is expressed by not the embodiment but claims, and includes the meaning equivalent to claims and all modifications within the scope.

Figure 4:
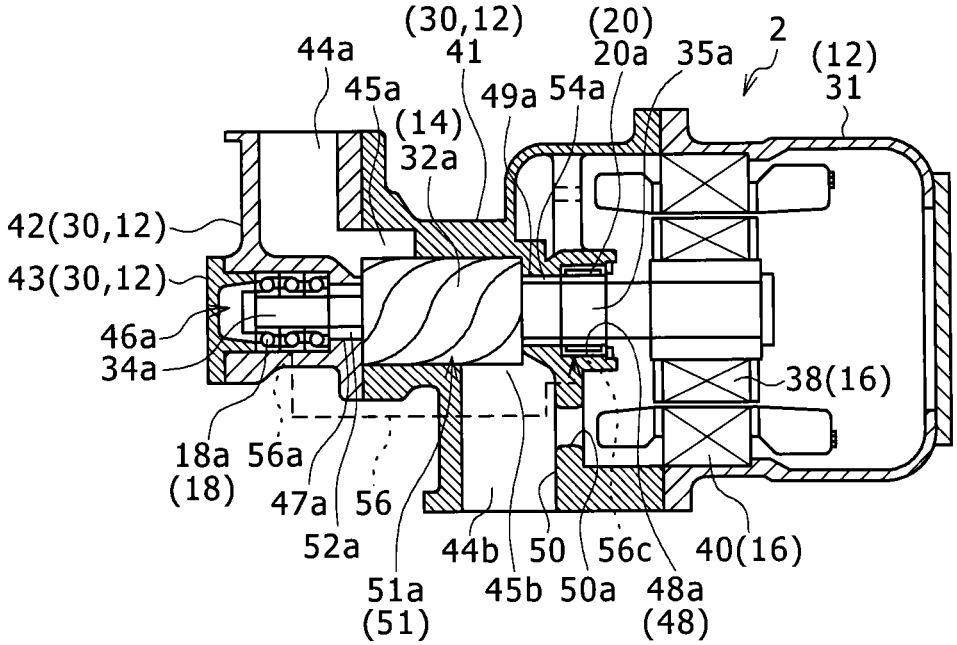
FIG. 4 is a schematic view illustrating a configuration of a power generation apparatus that uses an expander according to a first modified example of the present invention.

For example, as in the first modified example shown in FIG. 4, the other end 56*c* of the passage 56 that leads the lubricant from the first bearing chamber 46*a* may be connected to the second bearing chamber 48*a* and the other second bearing chamber (not shown). Since the second bearing chamber 48*a* and the other second bearing chamber communicate with the discharge port 44*b* through the space on the generator 16 side and the communication port 50*a*, the pressures thereof are substantially the same as the pressure inside the discharge port 44*b*. For this reason, the pressures of the second bearing chamber 48*a* and the second bearing chamber are lower than that of the first bearing chamber 46*a*, and hence the lubricant inside the first bearing chamber 46*a* is led to the second bearing chamber 48*a* and the other second bearing chamber through the passage 56 by the pressure difference. The lubricant that is introduced into the second bearing chamber 48*a* lubricates the second bearing 20*a*, and the lubricant that is introduced into the second bearing chamber lubricates the second bearing. The lubricant having been used for the lubrication is discharged to the discharge port 44*b* through the space on the generator 16 side and the communication port 50*a*. According to the first modified example, the lubricant having been used to lubricate the first bearings 18*a* and 18*b* may be used to lubricate the second bearing 20.

Figure 5:
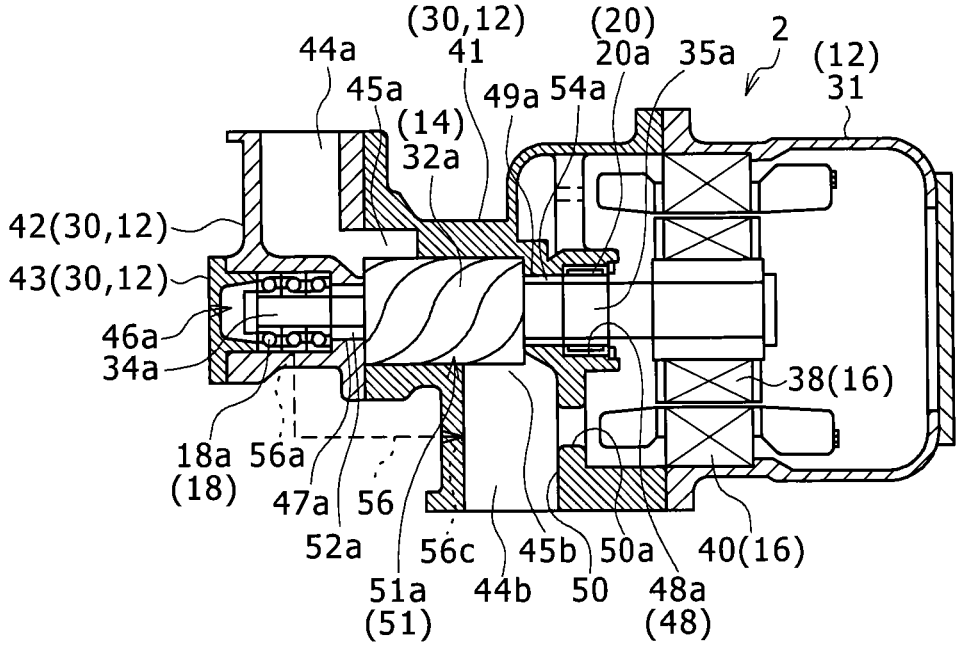
FIG. 5 is a schematic view illustrating a configuration of a power generation apparatus that uses an expander according to a second modified example of the present invention.

Further, as in the second modified example shown in FIG. 5, the end 56*c* of the passage 56 that leads the lubricant from the first bearing chamber 46*a* may be connected to the discharge port 44*b*. Since the pressure of the discharge port 44*b* is lower than that of the first bearing chamber 46*a*, the lubricant inside the first bearing chamber 46*a* is led to the discharge port 44*b* through the passage 56 by the pressure difference between the first bearing chamber 46*a* and the discharge port 44*b*. The lubricant that is led to the discharge port 44*b* is discharged to the outside of the casing 12 along with the working medium and the lubricant discharged from the vapor outlet 45*b* of the expansion chamber 51 to the discharge port 44*b*.

Figure 6:
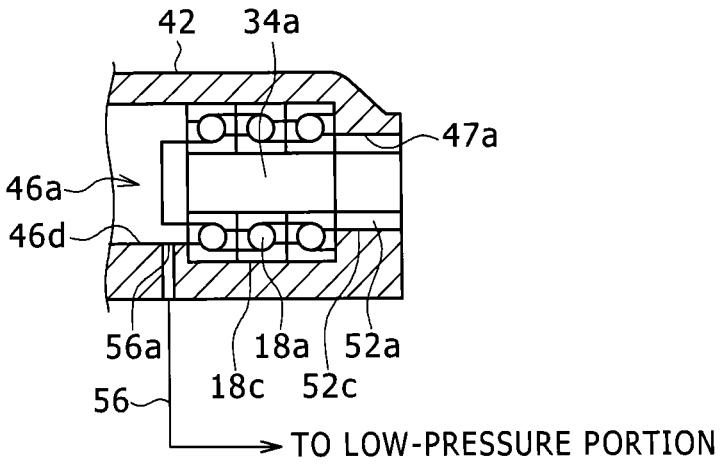
FIG. 6 is a schematic view partially illustrating a configuration of a power generation apparatus that uses an expander according to a third modified example of the present invention.

Further, as in a third modified example shown in FIG. 6, the passage 56 may be connected to the lower surface of the first bearing chamber 46*a*. Specifically, the lower surface of the first bearing chamber 46*a* is provided with a portion 46*d* that is located above the lowermost portion 18*c* of the first bearing 18*a* and is located below the lowermost portion 52*c* of the first shaft seal 52*a*, and the end 56*a* of the passage 56 is connected to the portion 46*d*. Even in the third modified example, the lubricant remains in the lowermost portion 18*c* of the first bearing 18*a* when the lubricant is discharged from the first bearing chamber 46*a* through the passage 56. For this reason, it is possible to prevent the oil shortage of the first bearing 18*a* during the activation of the power generation apparatus 2, and hence to suppress the damage and the degradation in durability of the first bearing 18*a*.

The present invention may be applied to not only the expander with two rotors but also the expander with a single rotor. For example, the present invention may be also applied to a scroll expander or a turbo expander.

What is claimed is:

1. An expander, comprising:

a casing that includes therein an expansion chamber into which lubricant and vapor of a working medium are introduced from a working medium feeding port;

an expander rotor that is rotationally driven by an expanding force transmitted from the vapor of the working medium introduced into the expansion chamber;

a first bearing provided adjacent to the working medium feeding port of the expansion chamber for supporting a rotation shaft of the expander rotor so that the expander rotor is rotatable;

a second bearing provided farther from the working medium feeding port than is the first bearing, and adjacent to a working medium lead-out port of the expansion chamber, for supporting the rotation shaft of the expander rotor so that the expander rotor is rotatable;

a first bearing chamber that is provided inside the casing and accommodates the first bearing, the pressure inside the first bearing chamber being lower than that of the feeding port of the expansion chamber, wherein a part of the working medium and the lubricant introduced from the working medium feeding port into the expansion chamber flow into the first bearing chamber by the pressure difference between the expansion chamber and the first bearing chamber; and a lubricant passage having an, end connected to the first bearing chamber at a position above a lowermost portion of the first bearing in the first bearing chamber, wherein the lubricant passage connects the first bearing chamber to a low-pressure portion having a pressure lower than that of the first bearing chamber, and wherein the lubricant that has been used to lubricate the first bearing while flowing into the first bearing chamber flows to the low-pressure portion through the lubricant passage due to the pressure difference between the first bearing chamber and the low-pressure portion.

2. The expander according to claim 1, wherein a shaft seal that seals the outer periphery of the rotation shaft is provided at a position between the first bearing chamber and the expansion chamber inside the casing, and a lower end of an end of the lubricant passage is located below a lowermost portion of the shaft seat.

3. The expander according to claim 2, wherein an end of the lubricant passage is connected to a side portion of the first bearing chamber.

4. The expander according to claim 1, wherein the casing is provided with a discharge port that has a pressure lower than that of the first bearing chamber and discharges the working medium discharged from the lead-out port of the expansion chamber to the outside of the casing, and the low-pressure portion is the discharge port.

5. The expander according to claim 1, further comprising:

a pair of expander rotors including the expander rotor;

a pair of the first bearings that supports the rotation shafts of the pair of expander rotors, wherein the casing includes therein a pair of the first bearing chambers respectively accommodating the pair of first bearings and a communication passage causing the pair of first bearing chambers to communicate with each other, and the communication passage is located above the lowermost portion of each first bearing.

6. An expander, comprising:

a casing that includes therein an expansion chamber into which lubricant and vapor of a working medium are introduced;

an expander rotor that is rotationally driven by an expanding force transmitted from the vapor of the working medium introduced into the expansion chamber;

a first bearing that supports a rotation shaft of the expander rotor to a working medium feeding port of the expansion chamber so that the expander rotor is rotatable;

a second bearing that supports the rotation shaft of the expander rotor to a working medium lead-out port of the expansion chamber so that the expander rotor is rotatable;

a first bearing chamber that is provided inside the casing and accommodates the first bearing, the pressure inside the first bearing a chamber being lower than that of the feeding port of the expansion chamber; and a lubricant passage having an end connected to the first bearing chamber at a position above a lowermost portion of the first bearing in the first bearing chamber and connecting the first bearing chamber to a low-pressure portion having a pressure lower than that of the first bearing chamber, wherein the expansion chamber includes an intermediate portion that is located between the working medium feeding port with respect to the expansion chamber and the working medium lead-out port from the expansion chamber and has an intermediate pressure between the feeding port and the lead-out port, and the low-pressure portion is the intermediate portion.

7. An expander, comprising:

a casing that includes therein an expansion chamber into which lubricant and vapor of a working medium are introduced;

an expander rotor that is rotationally driven by an expanding force transmitted from the vapor of the working medium introduced into the expansion chamber;

a first bearing that supports a rotation shaft of the expander rotor to a working medium feeding port of the expansion chamber so that the expander rotor is rotatable;

a second bearing that supports the rotation shaft of the expander rotor to a working medium lead-out port of the expansion chamber so that the expander rotor is rotatable;

a first bearing chamber that is provided inside the casing and accommodates the first bearing, the pressure inside the first bearing chamber being lower than that of the feeding port of the expansion chamber; and a lubricant passage having an end connected to the first bearing chamber at a position above a lowermost portion of the first bearing in the first bearing chamber and connecting the first bearing chamber to a low-pressure portion having a pressure lower than that of the first bearing chamber, wherein a second bearing chamber that has a pressure lower than that of the first bearing chamber and accommodates the second bearing is provided inside the casing, and the low-pressure portion is the second bearing chamber.

* * * * *